United States Patent [19]

Vasiliev et al.

[11] Patent Number: 4,554,966

[45] Date of Patent: Nov. 26, 1985

[54] HEAT-TRANSFER DEVICE

[76] Inventors: Leonard L. Vasiliev, ulitsa Kulman, 13, kv. 48.; Vladimir G. Kiselev, ulitsa Koltsova, 32, kv. 137.; Valery A. Morgun, ulitsa Slavinskogo, 35, Kv. 40.; Anatoly M. Marchenko, Leninsky prospekt, 72a, kv. 73., all of Minsk; Evgeny A. Rudnev, ulitsa Krasnoarmeiskaya, 8/10, kv. 23., Kharkov; Vasily A. Nesvit, ulitsa Sverdlova, 119, kv. 49., Kharkov; Leonid M. Dunaevsky, ulitsa Dzerzhinskogo, 59, kv, 50., Kharkov; Nikolai F. Tverdokhleb, Merfyanskoe shosse, 30, kv. 50., Kharkov; Vladimir M. Bogdanov, Leninky prospekt, 127, kv. 89.; Mikhail I. Rabetsky, ulitsa P. Glebki, 84, kv. 204., both of Minsk, all of U.S.S.R.

[21] Appl. No.: 500,254

[22] Filed: Jun. 2, 1983

[51] Int. Cl.[4] ..... F28D 15/00

[52] U.S. Cl. ..... 165/104.21; 165/76; 165/104.27; 165/142; 219/326; 219/341; 219/378; 219/530

[58] Field of Search ..... 165/104.21, 142; 219/530, 378

[56] References Cited

U.S. PATENT DOCUMENTS

| | | | |
|---|---|---|---|
| 1,607,152 | 11/1926 | Eggleston | 165/142 |
| 3,986,550 | 10/1976 | Mitsuoka . | |
| 4,050,509 | 9/1979 | Bienert . | |

FOREIGN PATENT DOCUMENTS

| | | | |
|---|---|---|---|
| 2161506 | 6/1973 | Fed. Rep. of Germany | 165/104.21 |
| 158871 | 12/1979 | Japan | 165/104.21 |
| 149588 | 11/1981 | Japan | 165/104.21 |
| 500133 | 2/1939 | United Kingdom | 165/104.21 |

OTHER PUBLICATIONS

Saaski et al., *A High Performance Cocurrent-Flow Heat Pipe for Heat Recovery Applications,* (pp. 1-8) 1980.

*Primary Examiner*—Albert W. Davis, Jr.
*Attorney, Agent, or Firm*—Ladas & Parry

[57] ABSTRACT

The present invention relates to heat engineering. The essence of the present invention consists in that a condensation chamber is installed essentially horizontally along the object being heated; the device comprises at least two branch pipes: vapour-flow and fluid-flow, which are used for communicating the space of the condensation chamber and the space of the tube with the space of the evaporation chamber.

7 Claims, 20 Drawing Figures

HEAT-TRANSFER DEVICE

TECHNICAL FIELD

The present invention relates to heat engineering and, more specifically, the invention relates to heat-transfer devices.

The invention can successfully be used in railroad transport for heating railroad switches, cabins of transport vehicles and railroad cars on electrically powered railroads.

Furthermore the invention can be used in those industrial fields (chemical, medical, microbiological), where rigid process requirements are imposed on the temperature of a heating surface, as well as for heating of temporary dwelling houses, such as movable houses used during erection of transport communications and gas and petroleum lines and for heating stock-rearing farms.

BACKGROUND OF THE INVENTION

Known in the art is a heat-transfer device disclosed in U.S. Pat. No. 3,986,550 which can be used as a heating device, as well as for removing heat when cooling various objects.

The known heat-transfer device comprises evaporation and condensation chambers made in the form of tanks, the space of the evaporation chamber, having liquid and vapour zones, is communicated with the space of the condensation chamber through a vapour-flow branch pipe and a fluid-flow branch pipe. For simplicity, these branch pipes will further be called as respectively, "vapour-flow branch pipe" and "fluid-flow branch pipe".

When heat is supplied into the evaporation chamber a liquid heat carrier is evaporated. The evaporated heat carrier is evaporated. The evaporated heat carrier through a vapour-flow branch pipe is admitted into the condensation chamber, where it is condensed giving the latent heat of evaporation to the object being heated. The condensed heat carrier flows into an evaporator through the fluid-flow branch pipe.

Due to the fact that in the known heat-transfer device the condensation chamber is made in the form of a tank, in which the length-to-diameter ratio is close to unity, this device cannot be used for heating of extended and horizontally located objects.

A heat-transfer device is known, which is desribed in the paper by E. W. Saaski J. C. Hartl, A High Performance Cocurrent-Flow Heat Pipe for Heat Recovery Applications" AJAA Paper 1980, v.1508.

The known heat-transfer device can be used for heating of extended objects located vertically or with a positive angle of inclination to the horizon.

The known heat-transfer device comprises an evaporation chamber whose space has vapour and liquid zones and a condensation chamber made in the form of a pipe-line provided with a partition mounted in the space along its longitudinal axis and used for directing the vapour into the space of the condensation chamber as well as for its returning the condensed liquid into the evaporation chamber.

The space of the condensation chamber is connected with an evaporation chamber through a fluid-flow branch pipe immersed into the liquid heat carrier.

In the known device the heat carrier vapours from the evaporation chamber are fed upwards into the condensation chamber, where they are condensed while passing along the longitudinal partition. A larger part of the condensed heat carrier returns by gravity into the condensation zone through the fluid-flow branch pipe.

The known device can be used for heating rather extended objects only if they are vertical and mounted at a positive angle of inclination of the device to the horizon because in this case reliable return of the condensed heat carrier into the condensation chamber is provided by gravity. With negative angles of inclination of the device to the horizon, when the evaporation chamber is located above the condensation chamber, the above-mentioned device is inoperative, because in this case the liquid heat carrier flows into the condensation chamber and the evaporation chamber is dried.

The operational efficiency of the given device with a horizontal arrangement is not high, because in this case, in the first place, only a portion of the inner surface of the evaporation chamber is covered by liquid heat carrier resulting in a decrease of the thermal power supplied to the evaporation chamber, and, in the second place, the liquid heat carrier covers a portion of the heat-transfer surface in the condensation chamber as a thick layer, and this also reduces the transmitted thermal power.

Furthermore in the case of the horizontal arrangement of the device, any increase in the length of the condensation zone with its low diameter results in formation of a stagnant zone at the end of the condensation chamber opposite to the evaporation chamber. The cooled liquid heat carrier, which does not take part in the "evaporation-condensation" process, will be accumulated in this stagnant zone. Therefore, the above-mentioned heat-transfer device can be used for heating only horizontally arranged objects having a small length and requiring a low thermal power.

A disadvantage of the known device is that it cannot be used for heating of extended, horizontally disposed objects.

Also known a heat-transfer device disclosed in U.S. Pat. No. 4,050,509, which can be used for heating of foundation of a roadbed by solar energy.

The known heat-transfer device comprises an evaporation chamber with at least one heating source. The space of an evaporation chamber is divided into a liquid zone and a vapour zone. The condensation chamber is located below the evaporation chamber and is made in the form of a pipeline, in the space of which along its longitudinal axis there is located a tube whose inner space is communicated with the spaces of the condensation and evaporation chambers. The tube is used for supplying vapour into the space of the condensation chamber and for returning the condensed liquid into the evaporation chamber.

The known heat-transfer device operates as follows. When heat is supplied to the evaporation chamber, the liquid heat carrier is evaporated and is fed through the pipe into the space of the condensation chamber. In this space the vapours of the heat carriers are condensed and the latent heat of evaporation is transferred to the object being heated. The process of heat transfer to the heated object is effected until the liquid heat carrier in the evaporation chamber is completely evaporated and the pressure in this chamber drops down. From this instant transfer of heat to the object being heated is stopped, while the liquid heat carrier is forced from the space of the condensation chamber into the evaporation chamber through the tube lowered under the level of the liquid heat carrier. This process is effected due to excessive pressure of the noncondensed gases in the space of the condensation chamber. As the liquid heat carrier is being forced from the condensation chamber to the evaporation chamber, the pressure in the condensation chamber drops down, while in the evaporation chamber the pressure increases due to evaporation of the liquid heat carrier fed into this chamber. When the pressure in the evaporation chamber exceeds that in the condensation chamber, the process of heat transfer to the heated object is renewed. This device is operative at a vertical arrangement of the condensation chamber or at angles of inclination close to vertical.

If the condensation chamber is placed horizontally, its heat transfer surface is considerably reduced, because only the upper half of the condensation chamber serves as a heating surface, because the lower half is filled with liquid heat carrier all the time. As a result, the transmitted thermal power is reduced. The thermal power transmitted is also reduced due to the required decrease in the velocity of the vapour flow in the tube so that the liquid heat carrier is capable of flowing from the condensation chamber into the evaporation chamber by gravity.

Thus, the known heat transfer device has the following disadvantage: it cannot be used for heating extended horizontally located objects with a magnitude of the transmitted thermal power equal to a few kilowatts and a relatively high ratio of the length of the condensation chamber to its diameter equal to 200–400 and higher.

BRIEF DESCRIPTION OF THE INVENTION

The main object of the present invention is to provide a heat-transfer device, which would be suitable for heating extended horizontally located objects.

This and other objects are attained by providing a heat-transfer device comprising an evaporation chamber with at least one heating source whose space is divided into liquid and vapour zones and a condensation chamber in a form of a pipeline, in the space of which along its longitudinal axis is mounted a tube whose space is communicated with the spaces of the condensation and evaporation chambers and used for supplying vapour into the space of the condensation chamber and for returning the condensed liquid into the space of the evaporation chamber; according to the present invention the space of the condensation chamber and the space of the tube are connected to the space of the evaporation chamber through at least two branch pipes: vapour-flow and fluid-flow, one of which is communicated with the vapour zone of the evaporation chamber and the other is communicated with the liquid zone of the evaporation chamber, in which case the condensation chamber is mounted essentially horizontally along the object being heated thereby. Due to this fact there is provided condensation of vapours of the heat carrier along the entire length of the condensation chamber and, therefore, constant temperature along the whole surface of the condensation chamber. The condensing flow of vapour passing through the condensation chamber entraps a film and drops of condensed heat carrier. The liquid heat carrier is transferred from the condensation chamber into the evaporation chamber through the fluid-flow branch pipe.

The motion of the vapour and vapour-and-liquid flows inside the heat-transfer device is associated with a pressure drop when overcoming the local resistances and resistances along its length. These resistances are overcome by consuming an insignificant portion of the potential energy of vapour generated in the evaporation chamber by the heat sources, which is again converted into the thermal energy.

The pressure loss is compensated by the column of liquid heat carrier in the fluid-flow branch pipe held due to said pressure drop.

The heat-transfer device can operate also at a negative angle of inclination of the condensation chamber to the horizon.

In the development of the design of the heat-transfer device operating under conditions of uniform or slowly varying heat removal along the condensation chamber, it is expedient to connect the spaces of the tube through a vapour-flow branch pipe with the vapour zone of the evaporation chamber, while the spaces of the condensation chamber are connected through a fluid-flow branch pipe to the liquid zone of the evaporation chamber. The vapour flow moving through the space of the tube into the space of the condensation chamber entraps the film and drops of the condensed heat carrier and then passes through the fluid-flow branch pipe into the liquid zone of the evaporation chamber. The vapour condensed in the tube space transfers the latent heat of evaporation through the tube wall, space and wall of the condensation chamber to the object been heated. The remaining portion of vapours of the heat carrier from the tube is directed into the space of the condensation chamber, where it is condensed giving a latent heat of evaporation through the wall of the condensation chamber to the object been heated.

In this case the isothermic property of the wall of the condensation chamber is provided with a uniform or slightly varying heat flow transmitted to the object. By changing the diameter of the tube and diameter of the condensation chamber, it is possible to select such a ratio of cross-sections of said elements that provides a minimum pressure drop in the heat-transfer device.

For a heat-transfer device operating condition of which is characterized by high variations of the thermal flow along the length of the condensation chamber, it is expedient to communicate the tube space through a fluid-flow branch pipe with the liquid zone of the evaporation chamber, while the spaces of the condensation chamber are preferably communicated through a vapour-flow branch pipe with the vapour zone of the evaporation chamber.

Due to the fact that the vapour from the vapour zone of the evaporation chamber is fed directly into the condensation chamber, the heat transfer from the condensed vapour to the heated object is effected directly through the wall of the condensation chamber at comparatively low thermal resistance.

Thus, the described embodiment of the heat-transfer device features good isothermic characteristics at a high rate of heat withdrawal along the length of the condensation chamber.

On developing a reliable, mechanically strong and technologically advantageous design of a heat-transfer device, it is expedient to mount a vapour-flow branch pipe inside a fluid-flow branch pipe, in which a partition is mounted to cut off the heat carrier flowing from the space of the condensation chamber from the vapor zone of the evaporation chamber, both branch pipes been immersed into the liquid zone of the evaporation chamber. In the given design the amount of vacuum-tight welded joints is reduced considerably.

The location of the vapour-flow branch pipe inside the fluid-flow branch pipe is expedient when developing extended heat-transfer devices operating in the open air, when the condensation chamber may be subjected to accidental mechanical actions.

In one embodiment of the design, it is expedient to make a partition cutting off the heat carrier flowing from the space of the condensation zone to the vapour zone. This partition is made in the form of a half-ring closing an annular gap between the walls of the vapour-flow branch pipe and the fluid-flow branch pipe, through which the condensed heat carrier returns to the evaporation chamber, said half-ring been mounted at an angle to a plate closing the longitudinal gaps between said walls of the branch pipes. In this case the amount of required materials is reduced and technological adaptability of mounting and erection work is improved.

In order to improve the operational reliability and widening the range of control of the transmitted thermal loads, the heat-transfer device is provided with a condenser whose space has vapour and liquid zones and is communicated with the space of the condensation chamber and with the liquid zone of the evaporation chamber through a fluid-flow branch pipe. In this case the condenser is equipped with a union for filling the evaporation chamber with heat carrier and for removing non-condensed gases from the device.

By displacing the "liquid-vapour" interface from the space of the condensation chamber into the space of the condenser, it is possible to provide an increase of the velocity of the vapour flow along the whole length of the condenser space.

In one embodiment of the heat-transfer device the condenser is located directly on the condensation chamber, in which case the heat removed by the condenser can be transferred directly to the heated object.

It is also expedient to arrange the condenser directly on the fluid-flow branch pipe, when for design consideration or by operating conditions of the heated object supply of heat from an additional condenser to the object is undesirable.

To provide efficient heat removal from the condenser, the latter may have external ribs.

In one embodiment of the heat-transfer device an additional heater is located in the vapour zone of the condenser and a drain valve is provided at the outlet from the fluid-flow branch pipe into the liquid zone to provide reliable draining of the condensed liquid from the space of the condensation chamber into the space of the evaporation chamber while reducing the hight of the fluid-flow branch pipe.

In order to accelerate the process of putting the device into operation and for improving its reliability, the device comprises an insert made of capillary-porous material and contacting the liquid zone of the evaporation chamber. This insert is rigidly connected to the fluid-flow branch pipe and cuts off the vapour coming from the vapour zone of the evaporation chamber. The insert of capillary-porous material is used for preventing penetration of liquid from the liquid zone of the evaporation chamber into the condensation chamber through the fluid-flow branch pipe during start-up of the device.

In one embodiment of the design of the heat-transfer device there is provided an insert heated by means of an additional heating source. The expediency of utilization of said design is based on the fact that, in the first place, the heat and mass transfer can be considerably intensified when the liquid is evaporated from the surface of the additional heating source whose overall dimensions in this case are reduced; in the second place, the overall dimensions of the evaporation chamber are reduced as well as the required height of disposition of the condensation chamber above the evaporation chamber.

In order to improve the manufacturing technology and to provide convenient transportion and mounting of the heat-transfer device whose condensation chamber has a length of a few dozens of meters, this chamber and the tube are made detachable.

In one embodiment of the device flanges with a gasket are provided at the joint on the condensation chamber, while the tube is provided with threaded couplings, and this ensures tightness of the connection of the condensation chamber with the tube without reducing the cross-section of said tube and space of the condensation chamber.

Taking into account a higher cost of this heat-transfer device compared to short heat pipes and for simplifying the process of filling the device with liquid and periodic release of non-condensed gases from the device, a valve is provided at the point of accumulation of non-condensed gases.

DETAILED DESCRIPTION OF THE INVENTION

Statics

Figure 1:
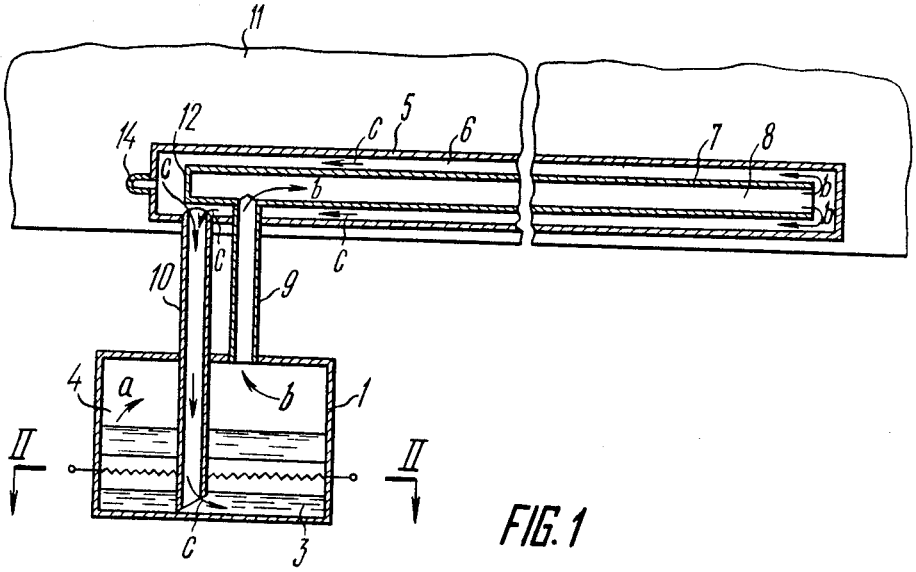
FIG. 1 is a general view of the heat-transfer device according to the invention; a longitudinal section.
Figure 2:
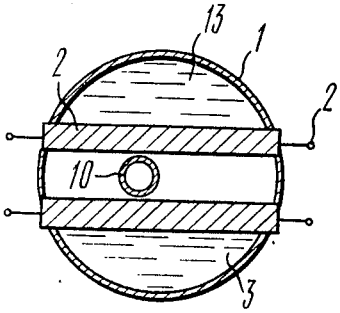
FIG. 2 is a sectional view along the line II—II in FIG. 1.

The heat-transfer device shown in FIGS. 1 and 2 intended, for example, for heating railroad switches comprises an evaporation chamber 1 with two heating sources 2, for example, electrical heating sources, which are hermetically sealed in the walls of the evaporation chamber 1. Besides electrical heaters, the heating sources 2 may be made in the form of other heaters, for example, gas-flame heaters, The space of the evaporation chamber 1 has a liquid zone 3 and a vapour zone 4. Mounted above the evaporation chamber 1 is a condensation chamber 5 made in the form of a pipeline. Mounted in the space 6 of the condensation chamber 5 along its longitudinal axis is a tube 7 having a space 8. The tube 7 is used for supplying vapour into the space 6 of the condensation chamber 5 and for returning the condensed liquid into the space of the evaporation chamber 1.

According to the invention, the heat-transfer device comprises two branch pipes: a vapour-flow branch pipe 9 and a fluid-flow branch pipe 10 (FIG. 2) extending between two heating sources 2. Depending on the shape of the object II being heated (FIG. 1) and a general layout of the evaporation chamber 1, the fluid-flow branch pipe 10 can be installed also in the other places of the liquid zone 3 of the evaporation chamber 1. The vapour zone 4 of the evaporation chamber 1 is communicated with the space 8 of the tube 7 by means of vapour-flow branch pipe 9. The face end of the tube 7 on the side of the vapour-flow branch pipe 9 is closed with a plug 12. The vapour-flow branch pipe 9 is connected to the side wall of the tube 7, extended through the side wall of the condensation chamber 5 and communicates the space 8 of the tube 7 with the vapour zone 4 of the evaporation chamber 1. The liquid zone 3 of the evaporation chamber 1 communicates through the fluid-flow branch pipe 10 with the space 6 of the condensation chamber 5. In the following description the reference numeral 5 may stand both for the condensation chamber and the pipeline. The space 8 of the tube 7 is communicated with the space 6 of the pipeline 5. The tiube 7 is arranged coaxially with respect of the condensation chamber 5. The condensation chamber 5 is located essentially horizontally along the heated object II. If the heated object II is a railroad switch, the condensation chamber 5 is mounted between the frame rail and the point of the railroad switch and is pressed by special clamps to the base of the frame rail.

The number of heating sources 2 is selected stamming from a required thermal power to be transmitted to the heated object II and the overall dimensions of the evaporation chamber 1. The evaporation chamber 1 is partially filled with a liquid heat carrier 13 (FIG. 2). Mounted on the condensation chamber 5 within the zone of location of the fluid-flow branch pipe is a union 14 (FIG. 1), for filling the heat-transfer device with heat carrier 13 and for removing non-condensed gases therefrom. This union may be installed at the point of expected accumulation of non-condensed gases.

Dynamics

All the embodiments of the heat-transfer device shown in FIGS. 1–2 operate as follows.

After the heating sources 2 have been switched on, the liquid heat carrier 13 in the liquid zone 3 of the evaporation chamber I is heated up. The liquid heat carrier 13 is evaporated and directed along the arrow "a" so that its vapour is fed in the direction shown by arrow "b" into the vapour zone 4 of the evaporation chamber I and then through the vapour-flow branch pipe 9 into the space 8 of the tube 7. Having partially condensed, the vapour flow passes through the space 8 of the tube 7 and enters the condensation chamber 5. In the space 6 of the pipeline 5 the vapour flow is condensed. Since the heat transfer from the vapour having been condensed in the space 8 of the tube 7 to the heated object II takes place through the gap between the outer wall of the tube 7 and inner wall of the condensation chamber 5 having a high thermal resistance, while the main vapour flow is consensed in the space 6 of the pipeline 5, the condensation chamber 5 features high isothermic properties. The condensed heat carrier 13 returns from the space 6 of the pipeline 5 along the arrow "c" through the fluid-flow branch pipe 10 into the liquid zone 3 of the evaporation chamber 1 by gravity.

The condensing vapour flow passing through the space 8 of the tube 7 and the space 6 of the pipeline 5 interacts with the film and drops of the heat carrier condensed in this space and transports the liquid to the fluid-flow branch pipe 10. During the operation of the heat-transfer device, between the vapour zone 4 of the evaporation chamber I and the space 6 of the pipeline 5 there is produced a pressure drop equal to the total pressure losses due to frition and local resistance caused by the transportation of vapour and vapour-and-liquid mixture inside the device. This pressure drop during the operation of the device results in a column of heat carrier in the fluid-flow branch pipe 10. The height of this column is equal to the ratio of the total pressure losses to the specific gravity of the heat carrier in the evaporation chamber 1. Thus, the height of the column of the heat carrier 13 in the fluid-flow branch pipe 10 and, therefore, the height of the fluid-flow branch pipe itself is calculated depending on the pressure drop inside the heat-transfer device.

Transportation of vapour and the vapour-and-liquid mixture inside the heat-transfer device requires a certain amount of potential energy of the vapour obtained in the evaporation chamber 1, which is again returned to the thermal energy transmitted to the heated object II.

From the study of the thermal and hydrodynamic processes in the heat-transfer device we find that this device is capable of operating within a wide range of change of angles of inclinations (positive and negative) of the condensation chamber 5 to the horizon. With respective selection of the height of the fluid-flow branch pipe 10, cross-sectional areas of the chambers 8 and 6 of the tube 7 and the pipeline 5 and their ratios, the heat-transfer device can transfer thermal energy of a few kilowatts to the horizontally located heated objects II having a length of a few dozens of meters.

The heat carrier 13 is drained from the fluid-flow branch pipe 10 into the liquid zone 3 of the evaporation chamber 1, for example, between the heating sources 2.

Since, in the heat-transfer device the length of the condensation chamber 5 considerably exceeds the linear size of the evaporation chamber 1, the operating capacity of the device largerly depending on the complete removal of the non-condensed gases from the inner spaces, is defined by the point of location of the union 14, through which the non-condensed gases are removed.

The device shown in FIGS. 1 and 2 is intended for transfer of heat to the object II when the thermal power being transferred is uniformly distributed along of the condensation chamber 5.

Statics

Figure 3:
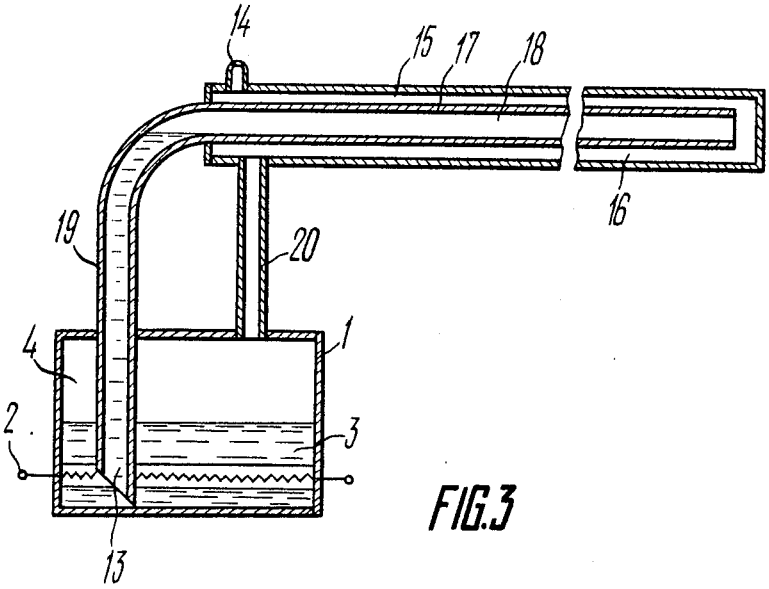
FIG. 3 is a general view of one of the embodiments of the heat-transfer device according to the invention; a longitudinal section.

Shown in FIG. 3 is a heat-transfer device intended for heat transfer to the object II been heated (not shown) with high variations of the thermal power transferred along the length of the condensation chamber 15.

The condensation chamber 15 is made in the form of a pipeline, in a space 16 of which there is mounted a tube 17 having a space 18 communicating with the space 16 of the condensation chamber 15.

The evaporation chamber of the heat-transfer device shown in FIG. 3 is similar to the evaporation chamber shown in FIG. 1 and is designated by the above-mentioned reference numerals. The space 18 of the tue 17 is communicated with the liquid zone 3 of the evaporation chamber 1 by means of a fluid-flow branch pipe 19. The space 16 of the condensation chamber 15 is communicated with the vapour zone 4 of the evaporation chamber 1 by means of a fluid-flow branch pipe 20 communicating with the space 16 of the condensation chamber 15 through its side wall.

Taking into account the internal processes occuring in the condensation chamber 15, the tube 17 is preferably located on the lower generating line of the condensation chamber 15 (not shown in the drawing).

Dynamics

The heat-transfer device shown in FIG. 3 operates as follows.

The vapours of the heat carrier 13 formed in the evaporation chamber 1 whose operation is described above are fed through the fluid-flow branch pipe 20 into the space 16 of the condensation chamber 15. The heat transfer from the condensing vapours of the heat carrier 13 to the heated object 11 takes place in the gap between the external wall of the tube 17 and the internal wall of the condensation chamber 15 with insignificant thermal resistance. The film of the condensed heat carrier 13 is transported by the vapour flow through the space 16, from which the condensed heat carrier 13 flows into the space 18 of the tube 17 and then through the fluid-flow branch pipe 19 flows by gravity into the liquid zone 3 of the evaporation chamber 1.

High heat flows transferred by the condensation chamber 15 to the heated object II result in a considerable consumption of condensed heat carrier flowing from the space 16 of the pipeline into the space 18 of the tube 17. Reliable and trouble-free operation of the heat-transfer device in this case is provided by locating the tube 17 on the lower generating line of the condensation chamber 15 to eliminate a stagnant zone for condensed heat carrier 13.

Figure 4:
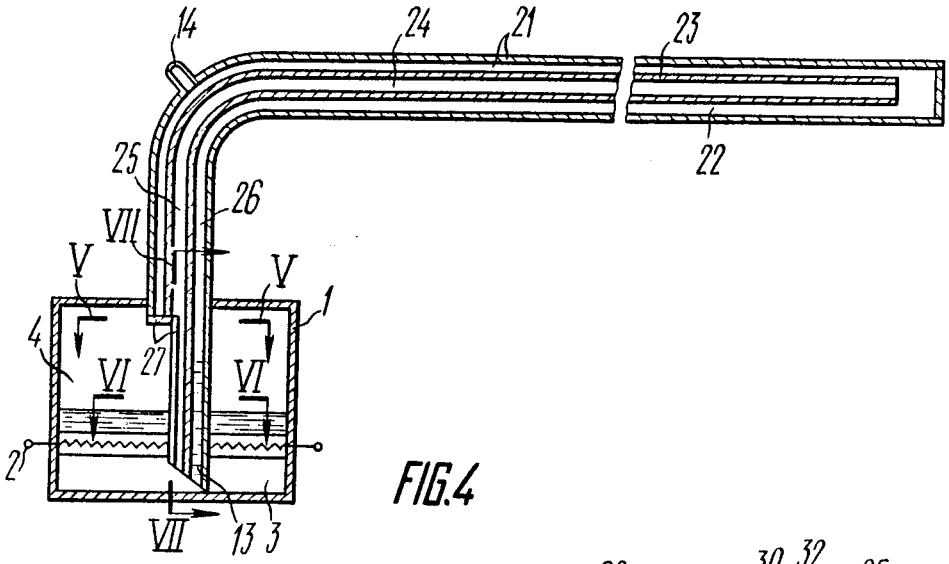
FIG. 4 is a general view of another embodiment of the heat-transfer device according to the invention; a longitudinal section.

The heat-transfer device shown in FIG. 4 is intended for heating objects where during the operation the device can be subjected to mechanical actions (impacts, vibration, etc.).

Statics

The evaporation chamber 1 of the heat-transfer device shown in FIG. 4 is similar to the evaporation chamber 1 in FIG. 1 and is designated with the same reference numerals.

The condensation chamber 21 is made in the form of a pipeline, in the space 22 of which there is located a tube 23 whose space 24 is communicated with the space 22 of the condensation chamber 21 or, which as a rule, is the same as the pipeline 21.

The device comprises a vapour-flow branch pipe 25 and a fluid-flow branch pipe 26, the vapour-flow branch pipe 25 being located inside of the fluid-flow branch pipe 26, in which there is mounted a partition 27 cutting off the heat carrier 13 flowing from the space 22 of the piepline 21 from the vapour zone 4 of the evaporation chamber 1; both branch pipes 25 and 26 are immersed into the liquid in the zone 3.

Dynamics

The operation of the heat-transfer device shown in FIG. 4 is similar to the operation of the heat-transfer device (FIGS. 1,2,3), which was described above. Let us discuss some specific features of hydrodynamics and mass transfer processes taking place in the heat-transfer device shown in FIG. 4.

The partition 27 cuts off the heat carrier 13, which flows from the space 22 of the pipeline 21, from the vapour zone 4 of the evaporation chamber 1. Due to the fact that the vapour-flow 25 and the fluid-flow 26 branch pipes are immersed into the liquid zone 3 of the evaporation chamber 1, penetration of vapours of the heat carrier 13 directly from the vapour zone 4 into the fluid-flow branch pipe 26 is prevented. The processes of transfer of the heat carrier from the vapour-flow branch pipe 25 into the space 24 of the tube 23 and transfer of the condensed heat carrier from the space 22 of the pipe-line 21 into the fluid-flow branch pipe 26 occurs with low hydraulic resistance. This is due to the fact that the cross-sections of the vapour-flow 25 and the fluid-flow 26 branch pipes are equal, as well as the cross-sections of the space 24 of the tube 23 and the space 22 of the pipeline 21. Furthermore, these elements are connected through smooth turns with sufficiently large bending radii.

Statics

Figure 7:
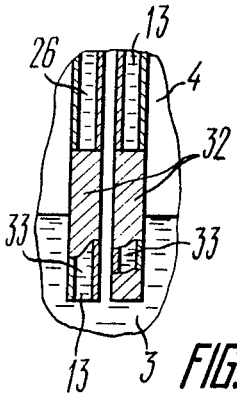
FIG. 7 is a sectional view along the line VII—VII in FIG. 4.
Figure 6:
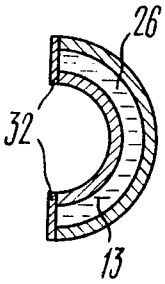
FIG. 6 is a sectional view along the line VI—VI in FIG. 4.
Figure 5:
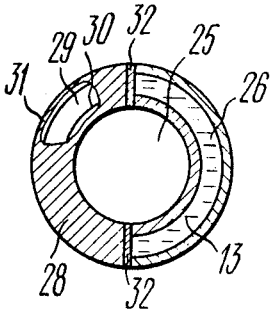
FIG. 5 is a sectional view along the line V—V in FIG. 4.

In the heat-transfer device shown in FIG. 4 the partition is made in the form of a half-ring 28 (FIG. 5) closing the annular gap 29 between the walls 30 and 31, respectively, of the vapour-flow branch pipe 25 and the fluid-flow branch pipe 26, through which the liquid carrier 13 returns to the evaporation chamber 1, said half-ring been mounted at an angle to plates 32 (FIGS. 6,7) closing the longitudinal gaps 33 between said walls 30 and 31 of the branch pipes 25 and 26.

Dynamics

The partition 27 prevents direct contact of vapour of the heat carrier entering the vapour-flow branch pipe 25 with the liquid heat carrier passing through the fluid-flow branch pipe 26. The condensed heat carrier 13 passes through the fluid-flow branch pipe 26 to the half-ring 28, which prevents its drain through the annular gap 29 into the vapour zone 4 of the evaporation chamber 1. From the half-ring 28 the liquid heat carrier flows into the longitudinal gap 33 between the walls 30 and 31 and is admitted into the liquid zone 3 of the evaporation chamber 1. The plates 32 prevent direct contact of the heat carrier vapours with the liquid heat carrier in the longitudinal gap 33.

Statics

Figure 8:
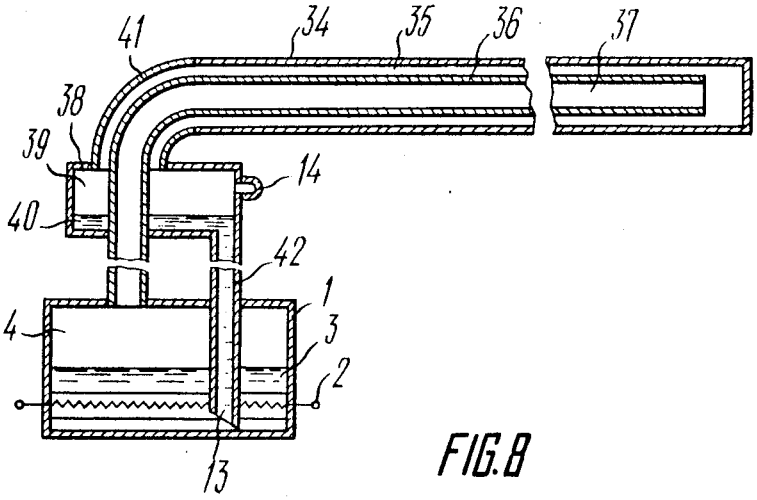
FIG. 8 is a general view of still another embodiment of the heat-transfer device according to the invention; a longitudinal section.

The heat transfer device shown in FIG. 8 is intended for heating objects whose operating conditions require high isothermic parameters.

The heat-transfer device comprises a condensation chamber 34 made in the form of a pipeline, in the space 35 of which a tube 36 is mounted. The space 37 of the tube 36 communicates with the space 35 of the condensation chamber 34.

The heat-transfer device also comprises a condenser 38 whose space has a vapour zone 39 and a liquid zone 40 and through an adapter 41 is communicated with the space 35 of the condensation chamber 34. The space of the condenser 38 through a fluid-flow branch pipe 32 communicates with the liquid zone 3 of the evaporation chamber 1, whose design is similar to that of the evaporation chamber 1 (FIG. 1) and is designated by the above-mentioned reference numerals.

The condenser 38 is provided with a union 40 for filling the device with heat carrier 13 and for removing non-condensed gases from the heat-transfer device.

Dynamics

The operation of the heat-transfer device shown in FIG. 8 is similar to the operation of the device shown in FIGS. 4, 5, 6, 7 and is described above. With the presence of a condenser 48 the condensed heat carrier flows from the space 45 through the adapter 41 into the condenser 48 and then along the fluid-flow branch pipe 42 into the liquid zone 3 of the evaporation chamber 1.

A certain amount of heat carrier vapours from the space 35 of the condensation chamber 34 flows into the space of the condenser 39. Thus, by controlling the heat removal from the surface of the condenser 39, it is possible to displace the "liquid-vapour" interface from the space 35 to the space of the condenser 38. This improves the isothermic properties of the condensation chamber 34 for extended horizontally located objects II to be heated.

During long-term operation of the heat-transfer device some of non-condensed gases may appear in its internal spaces and the presence of these gases adversely affects the operation of the device. Since the non-condensed gases are as a rule accumulated in the most remote part of the condensation chamber 34 (along the vapour flow), the condenser 38 serves as a storage tank for non-condensed gases during the operation of the heat-transfer device. Thus, the isothermic parameters of the condensation chamber 34 are improved. The union 14 mounted on the condenser 38 and used for filling the evaporation chamber 1 with the heat carrier 13 makes it possible to improve the technology of making the heat-transfer device, increase its reliability and service life, because in this case the non-condensed gases are completely removed.

Statics

Figure 9:
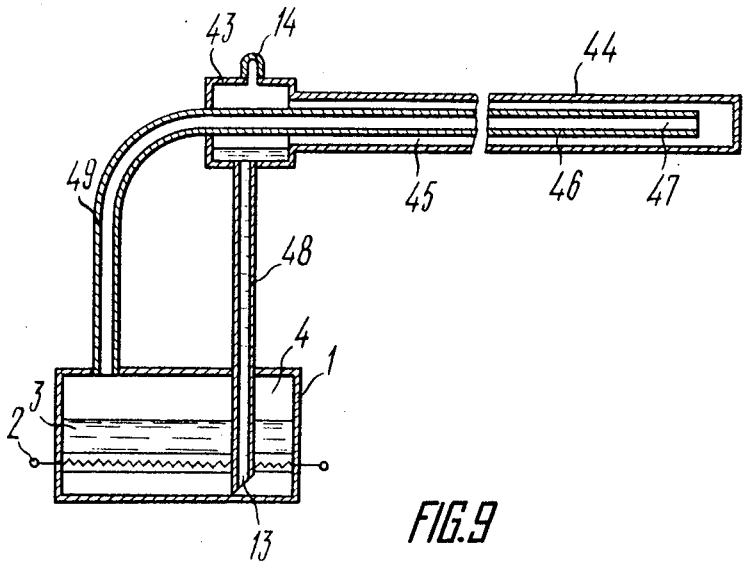
FIG. 9 is a general view of still another embodiment of the heat-transfer device according to the invention; a longitudinal section.

In one embodiment of the heat-transfer device, which is shown in FIG. 9 and can be used for heating extended objects having recesses of an arbitrary shape on their surface, the condenser 33 is mounted directly on the housing of the condensation chamber 44.

The condensation chamber 44 is made in a form of a pipeline whose space 45 accommodates a tube 46 having a space 47 communicating with the space 45 of the condensation chamber 44.

The evaporation chamber 1 of the heat-transfer device shown in the FIG. 9 is similar to the evaporation chamber 1 in FIG. 1 and is designated by the above-mentioned reference numerals.

The space of the condenser 43 through a fluid-flow branch pipe 49 communicates with the liquid zone 3 of the evaporation chamber 1. The space 47 of the tube 46 communicates through the vapour-flow branch pipe 49 with the vapour zone 4 of the evaporation chamber 1. The union 14 is mounted on the condenser 43.

Dynamics

The operation of the heat-transfer device shown in FIG. 9 was described above. The heat carrier condensed in the condensation chamber 44 is transported from the space 45 directly into the condenser 43 and then into the liquid zone 3 of the evaporation chamber 1. The surface temperature of the condensation chamber 44 is controlled by changing the amount of thermal energy removed from the surface of the condenser 43, in which case this thermal energy can also be transmitted to the object II being heated.

Statics

Figure 11:
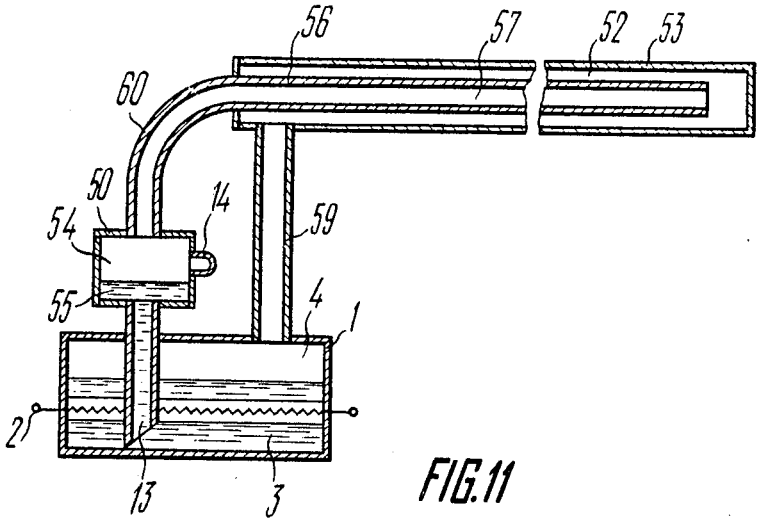
FIG. 11 is a general view of still another embodiment of the heat-transfer device according to the present invention; a longitudinal section.
Figure 10:
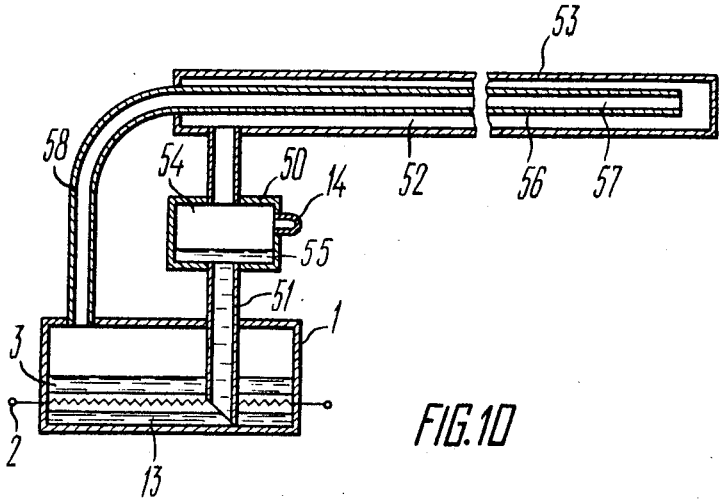
FIG. 10 is a general view of still another embodiment of the heat-transfer device according to the present invention; a longitudinal section.

The embodiments of the heat-transfer device shown in FIGS. 10 and 11 are intended for heating objects requiring maintanence of a constant temperature along a large distance; the embodiment shown in FIG. 11 can be used with a considerable deviation of the amount of thermal power taken off along the length of the condensation chamber 44 from the average value.

The condenser 50 is mounted directly on a fluid-flow branch pipe 51 (FIG. 10) communicating with the space 52 of the condensation chamber 53. The space of the condenser 50 is divided into a vapour zone 54 and the liquid zone 55. The condensation chamber 53 is made in the form of a pipeline, in the space 52 of which a tube 56 is installed.

The evaporation chamber 1 of the heat-transfer devices presented in FIGS. 10 and 11 is similar to the evaporation chamber 1 in FIG. 1 and is designated by the above-mentioned reference numerals.

A space 57 of the tube 56 is communicated with the vapour zone 4 of the evaporation chamber 1 (FIG. 10). The fluid-flow branch pipe 51 communicates the space 52 with the space of the condenser 50 and the liquid zone 3 of the evaporation chamber 1.

The space 52 can be communicated through a vapour-flow branch pipe 59 with the vapour zone 4 of the evaporation chamber 1 (FIG. 11). In this case the condenser 50 is mounted on a fluid-flow branch pipe 60 communicating the space 57 of the tube 56 with the liquid zone 3 of the evaporation chamber 1.

Mounted on the condenser 50 (FIGS. 10 and 11) is a union 14 used for filling the device with heat carrier 13 and for removing the non-condensed gases.

Dynamics

The operation of the heat-transfer device shown in FIGS. 10 and 11 was given above, when describing the operation of the device shown, respectively, in FIGS. 1 and 3. It will be noted that due to mounting of the condenser 50 directly on the fluid-flow branch pipe 60 the isothermic conditions of the condensation chamber 53 (FIG. 11) are considerably improved. This is provided by increasing the rate of circulation of the vapour and liquid phases of the heat carrier in the space 52 of the condensation chamber 53 and in the space 57 of the tube 56 by displacing the "vapour-liquid" interface from the space 57 of the tube 56 to the space of the condenser 50 by taking off some thermal power from the surface of the condenser 50. Thus, we reduce probability of formation of a stagnant zone of liquid heat carrier at the point of its transfer from the space 52 of the condensation chamber 53 into the space 57 of the tube 56.

Statics

In still another embodiment of the heat-transfer device (FIG. 12) the condenser 61 is provided with external ribs 62 and is mounted directly on the fluid-flow branch pipe 53. Mounted on the condenser 61 in a union 14 used for filling the device with heat carrier 13 and for removing the non-condensed gases from the device.

Figure 12:
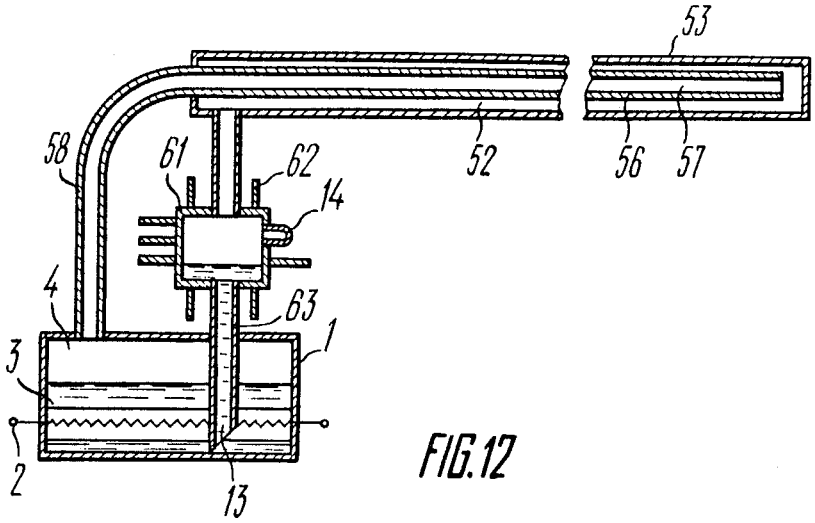
FIG. 12 is a general view of still another embodiment of the heat-transfer device according to the present invention; a longitudinal section.

The condensation chamber 53 and the evaporation chamber 1 of the heat-transfer device shown in FIG. 12 are similar, respectively, to the condensation chamber 53 shown in FIG. 10 and the evaporation chamber 1 shown in FIG. 1 and having the same reference numerals.

Dynamics

The operation of the heat-transfer device shown in FIG. 12 was described above.

If the condenser 61 is provided with external ribs 62 the heat-exchange surface of this condenser is increased so that it is possible to increase the thermal power taking from the condenser 61 and to widen a possible range of control of circulation of heat carrier in the heat-transfer device. Thus, we considerably improve the isothermic parameters of the condensation chamber 53 at large variations of the thermal power taking along the length of the condensation chamber 53.

Statics

Figure 13:
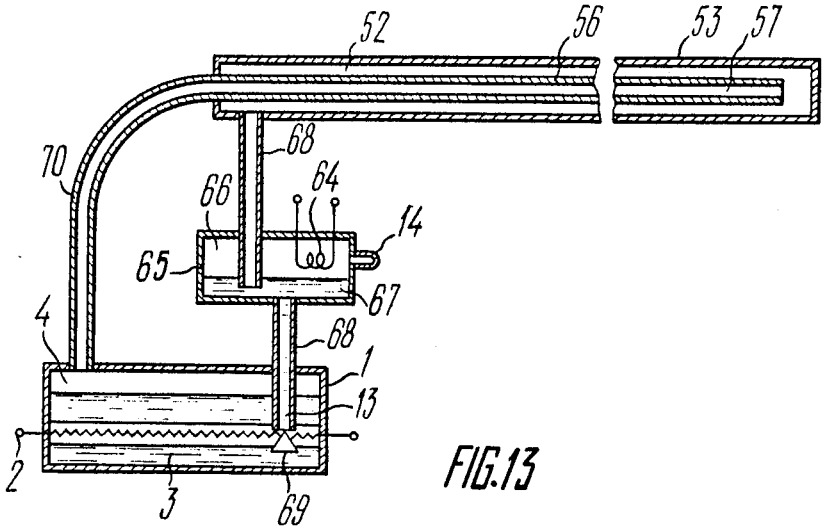
FIG. 13 is a general view of still another embodiment of the heat-transfer device according to the present invention, a longitudinal section.

In the embodiment of the designs of the heat-transfer device shown in FIGS. 8–12 the condenser is used for removing some amount of heat and for changing thermomechanical parameters of the condensation chamber. A decrease in a required height of mounting the condensation chamber above the evaporation chamber can be obtained by placing a heater 64, for example, an electric heater, in the condenser 65 in its zone 66 (FIG. 13). The space of the condenser 65 is divided into a vapour zone 66 and a liquid zone 67.

The condensation chamber 53 and the evaporation chamber 1 of the heat-transfer device shown in FIG. 13 are similar, respectively, to the condensation chamber 53 shown in FIG. 10 and the evaporation chamber 1 shown in FIG. 1 and have the same reference numerals.

A drain valve 69 is mounted at the outlet of the fluid-flow branch pipe 68 connected to the liquid zone 3. The space 57 of the tube 56 is communicated through a vapour-flow branch pipe 70 with the vapour zone 4 of the evaporation chamber 1.

Dynamics

The operation of heat-transfer device shown in FIG. 13 was described above; the condenser 65 with a heater 64 operates as follows.

The condensed heat carrier 13 flows from the space 52 of the condensation chamber 53 through the fluid-flow branch pipe 68 into the condenser 65. SInce, the drain valve 69 is adjusted so that it opens at a height of the liquid zone 67 corresponding to the immersion of the heater 64 into the liquid, the heater 64 in the condenser 65 will periodically be flooded by heat carrier 13. When the heater 64 is flooded with heat carrier 13 and is switched on, the heat carrier 13 will boil intensively. The pressure in the space of the condenser 65 increases and the heat carrier 13 starts moving through the fluid-flow branch pipe 68 up and down opening the drain valve 69. Since, the resistance of the fluid-flow branch pipe 68 between the condenser 65 and the liquid zone 3 is lower than the resistance of the fluid-flow branch pipe 68 between the condenser 65 and the space 52 of the condensation chamber 53, the larger portion of the heat carrier 13 will be transferred into the evaporation chamber 1.

After that the operating cycle of the device is repeated: the drain valve 69 closes again, the heat carrier 13 is accumulated in the fluid-flow branch pipe 68, a liquid zone 67 of the condenser 65 until the heat carrier 13 comes in contact with a hot heater 64 and the pressure in the space of the condenser 65 rises up. Thus, the thermal energy of the heater 64 is consumed for pumping the condensed heat carrier 13 from the space 52 of the condensation chamber 53 into the liquid zone 3 of the evaporation chamber 1. The main portion of the heat carrier evaporated in the condenser 65 comes in a vapour state into the space 52 of the condensation chamber 53, where the vapour is condensed giving the latent heat of evaporation to the object II been heated. The heater 64 together with the drain valve 69 operates as a pump provided that the hydraulic resistance of the fluid-flow branch pipe 68 above the condenser 65 exceeds the hydraulic resistance of the fluid-flow branch pipe 68 under the condenser 65 (FIG. 13). This makes it possible to achieve reliable operation of the heat-transfer device and to provide good isothermic conditions for the condensation chamber 63 while reducing a required height of mounting the condensation chamber 53 above the evaporation chamber 1.

Statics

Figure 14:
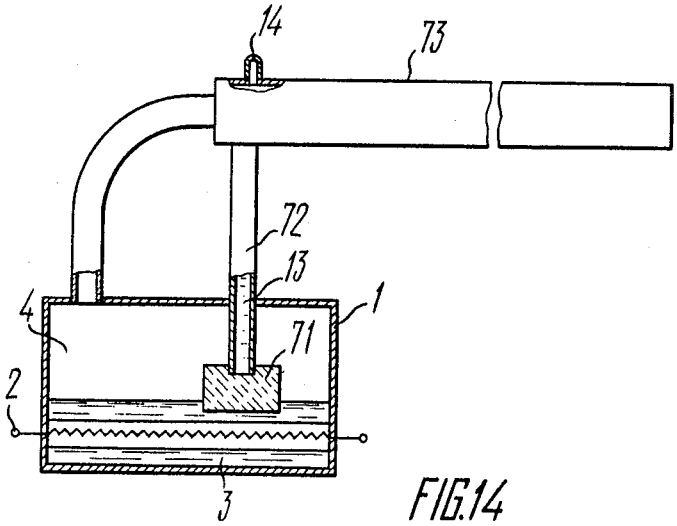
FIG. 14 is a general view of still another embodiment of the heat-transfer device according to the present invention; a longitudinal section.

The heat-transfer device shown in FIG. 14 is used for transferring heat to an object being heated, when the operating conditions require control of the transmitted power. This is provided due to the fact that the device comprises an insert 71 made of a capillary-porous material and contacting the liquid zone 3 of the evaporation chamber 1 described and designated above. The insert 71 is rigidly connected to a fluid-flow branch pipe 72 and cuts off the vapour from the vapour zone 4 of the evaporation chamber 1 and does not allow the vapour to enter the branch pipe 72.

A condensation chamber 73 is made in the form of a pipeline, which in the zone of connection with the fluid-flow branch pipe 72 has a union 14 for filling the device with heat carrier and for removing the non-condensed gases from the device.

Dynamics

The operation of the heat-transfer device shown in FIG. 14 is described above. The condensed heat carrier 13 from the condensation chamber 73 enters the fluid-flow branch pipe 72 and, having passed through the insert 71 made of a capillary-porous material flows into the liquid zone 3 of the evaporation chamber 1. If the operating conditions of the heated object II require, for example, an increase in the supplied thermal power, an increase in the power of the heating source 2 results in boiling the heat carrier 13 in the liquid zone 3 of the evaporation chamber 1 and a rise of the vapour pressure in the vapour zone 4. In this case the insert 71 prevents penetration of heat carrier 13 from the liquid zone 3 into the condensation chamber 73 through the fluid-flow branch pipe 72 due to the formed pressure drop.

The insert 71 also makes it possible to carry out an accelerated start of the heat-transfer device from a cold state preventing penetration of heat carrier into the condensation chamber.

Figure 15:
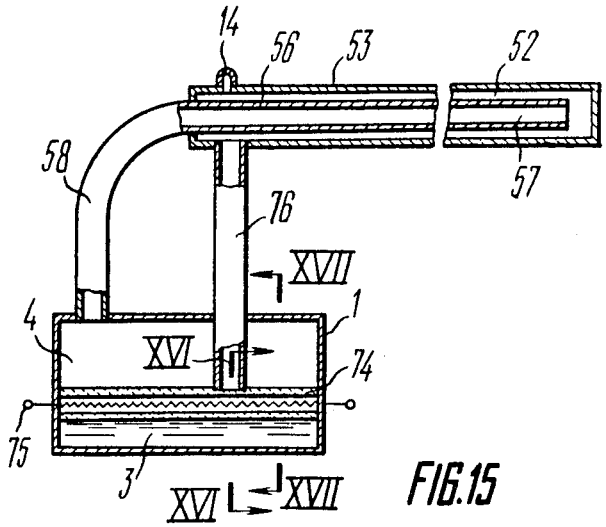
FIG. 15 is a general view of still another embodiment of the heat-transfer device according to the present invention; a longitudinal section.
Figure 16:
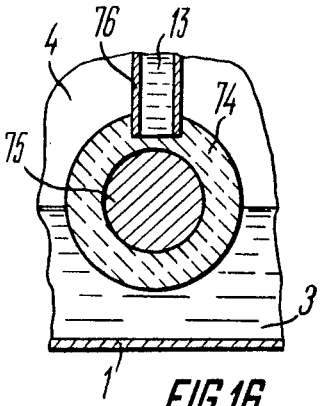
FIG. 16 is a general view of still another embodiment of the heat-transfer device according to the present invention; a longitudinal section.
Figure 17:
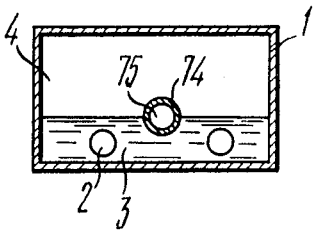
FIG. 17 is a general view of still another embodiment of the heat-transfer device according to the present invention; a longitudinal section.

A specific feature of the heat-transfer device shown in FIGS. 15, 16 and 17 is a reduced height of mounting the condensation chamber above the evaporation chamber for increasing the operational reliability of the device under starting and transient conditions. This is attained due to the fact that the insert 74 made of a capillary-porous material is heated by an additional heating source 75. The additional heating source may include, for example, electric and gas-plasma heaters.

Statics

The condensation chamber 3 and the evaporation chamber 1 of the heat-transfer device shown in FIG. 15 are similar, respectively, to the condensation chamber 53 shown in FIG. 12 and the evaporation chamber 1 shown in FIG. 1 and they have the same reference numerals.

The additional heating source 75 is hermetically mounted in the walls of the evaporation chamber 1 and partially immersed into the liquid zone 3 of the chamber 1 (FIGS. 15, 16, 17). The insert 74 of a capillary-porous material is made in the form of an envelope covering the additional heating source 75. The fluid-flow branch pipe 75 is introduced into the insert 74 (FIGS. 15, 16), which is rigidly secured thereto.

The vapour zone 4 of the evaporation chamber 1 (FIG. 15) is communicated through the space 57 of the tube 56 through the vapour-flow branch pipe 58. Mounted on the condensation chamber 55 is a union 14 for filling the device with heat carrier and for removing the non-condensed gases therefrom.

Dynamics

The operation of the heat-transfer device shown in FIGS. 15, 16 and 17 is described above. Let us describe in detail the internal processes taking place in the device equipped with a heat insert 74 made of a capillary-porous material.

If the insert 74 is heated (FIG. 15), in the first place, it prevents any leakage of the vapours of the heat-carrier 13 from the vapour zone 4 into the fluid-flow branch pipe 63 and eliminates penetration of heat carrier 13 from the liquid zone 3 into the space of the condensation chamber 53, when starting the heat-transfer device. In the second place, the heated insert 74 operates also as a pump pumping the heat carrier from the fluid-flow branch pipe 76 into the liquid zone 3. The heat carrier is pumped from the fluid-flow branch pipe 76 into the liquid zone 3 under the effect of the capillary forces of the insert 74. It will be noted that the lower the diameter of the material of the insert 74, the higher the capillary pressure, and the high pressure drop between the fluid-flow branch pipe 76 and the space of the evaporation chamber 1 can be overcome by the capillary forces of the material of the insert 74. Thus, if the insert 74 is heated (FIG. 15), the claimed device is also advantageous in that the heat and mass transfer processes are intensified, when the heat carrier is evaporated from the surface of the additional heating source 75. In this case the dimensions of the evaporation chamber I are reduced by a high-power and small-size additional heating source 75. A probability of burn-out of the additional heating source 74 is reduced, because, in the first place, it is wetted by the liquid coming from the fluid-flow branch pipe 76 and penetrating into the insert 74 (FIG. 16), and, in the second place, the insert 74 under the action of capillary forces sucks in the liquid from the liquid zone 3 into which this insert is immersed (FIGS. 16 and 17).

The use of the insert 74 (FIG. 15) made of a capillary-porous material and heated by an additional heating source 75 makes it possible to considerably reduce the height of mounting the condensation chamber 53 above the evaporation chamber 1 thus increasing the operational reliability of heat-transfer device and reducing its weight.

Statics

Figure 18:
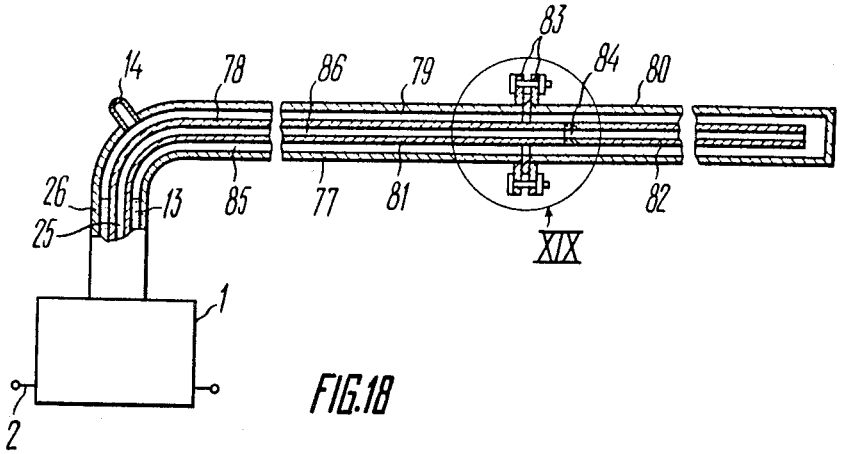
FIG. 18 is a general view of still another embodiment of the heat-transfer device according to the present invention; a longitudinal section.

The heat-transfer device shown in FIG. 18 is intended for heating objects having a length of a few dozens of meters, if it is not possible to mount a heating device in the immediate vicinity of the object to be heated. In this case it is expedient to make the condensation chamber 77 and tube 76 as detachable units. The condensation chamber 75 is made of a pipeline 79 and a pipeline 80, whiel the tube 78 consists of a pipe 81 and a pipe 82. The pipelines 79 and 80 are interconnected through a hermetically-tight joint 83, while the pipes 81 and 82 are interconnected through a joint 84 where tightness is not needed.

The space 85 of the pipeline 79 is communicated through the fluid-flow branch pipe 26 with the vapour zone 4 of the evaporation chamber 1. Similar to the evaporation chamber shown in FIG. 4 and designated above. The space 86 of the tube 81 is connected to a vapour-flow branch pipe 25 similar to the vapour-flow branch pipe 25 shown in FIGS. 4,5,6,7.

Dynamics

The operation of the heat-transfer device shown in FIG. 18 was described above in the description of the device shown in FIGS. 1,2 and 4–7.

The hermetically-tight joint 83 prevents leakage of a heat carrier 13 from the inner spaces of heat-transfer device and also penetration of abmient air into the device.

Statics

Figure 19:
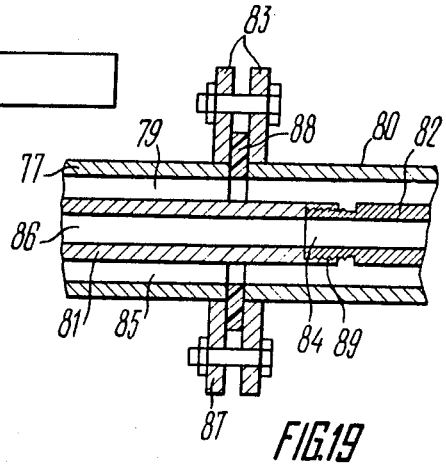
FIG. 19 is a general view of still another embodiment of the heat-transfer device according to the present invention; a longitudinal section.

Shown in FIG. 19 is a design of a joint on the condensation chamber 77 shown in FIG. 18.

Mounted on the condensation chamber 77 on its pipelines 79 and 80 are flanges 87 with a gasket 88, while the pipes 81 and 82 are provided with a threaded coupling 86. The pipes 81 and 82 can be connected by other methods, for example, through friction.

Dynamics

The operation of the device shown in FIG. 19 was described above and is similar to the operation of the device shown in FIG. 18.

Statics

Figure 20:
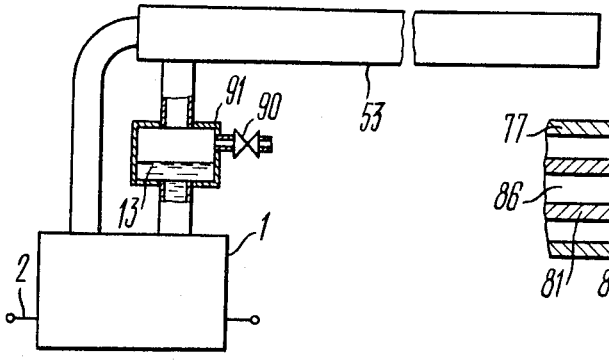
FIG. 20 is a general view of still another embodiment of the heat-transfer device according to the present invention; a longitudinal section.

The heat-transfer device shown in FIG. 20 is intended for long-term operation. For this purpose, it is provided with a valve 90 mounted at the point of accumulation of non-condensed gases and used for periodic release of these gases from the device.

The condensation chamber 53 and the evaporation chamber 1 of the heat-transfer device shown in FIG. 20 are similar, respectively, to the condensation chamber 53 shown in FIG. 10 and the evaporation chamber 1 shown in FIG. 1 and have the same reference numerals.

The valve 90 is mounted on a condenser 91.

Dynamics

The operation of the heat-transfer device shown in FIG. 20 was described above.

During long-term operation of the heat-transfer device non-condensed gases can be accumulated therein. In the inoperative device the non-condensed gases are uniformly distributed in a vapour phase of the heat carrier.

Due to the fact that in the operating heat-transfer device the vapour phase moves continuously from the evaporation chamber I to the condensation chamber 53, the non-condensed gases are transferred to the most remote point of the condensation chamber 53, i.e. to the condenser 91. The non-condensed gases are removed from the device by opening the valve 90 in the operating heat-transfer device. If necessary, the heat-transfer device is filled with heat carrier 13 through the valve 90.

THE EFFICIENCY OF THE INVENTION IS CONFIRMED BY CONCRETE EXAMPLES

Example 1

The heat transfer device is used for heating a railroad switch 6 m long. The overall dimensions of heat-transfer device are as follows:

| | |
|---|---|
| Length of condensation chamber, m . . . | 4.5 |
| Outer diameter of condensation chamber, m | 0.016 |
| Height of mounting the condensation chamber above liquid zone of evaporation chamber, m | 0.6 |
| Dimensions of evaporation chamber in plane, $m^2$ | 0.24 × 0.33 |
| Power of electric heating sources in heat-transfer device, W | 2000 |
| Heat carrier | acetone |
| Quantity of liquid heat carrier in heat-transfer device, l | 2.5 |

The railroad switch was equipped with two heat-transfer devices. In this case the condensation chambers were arranged in the space between the frame rail and the point and were pressed by clamps to the frame rail.

The evaporation chamber coated with a heat insulation and hydraulic insulation was installed in a special groove between the rails and between the sleepers of the railroad bed from the side of the entry to the switch.

The tests were conducted at an ambient air temperature of −5° C. to 7° C. with snowfall intensity of 100–150 mm of snow during 24 hours. The wind velocity changed in a range from 5 to 10 m per second.

Prior to the operation of the heat transfer device, the switch was covered by a layer of snow of 50–100 mm thick.

25–30 min after the voltage was applied to the heating sources, the snow started melting between the frame rail and the point in the immediate vicinity of the condensation chamber. After 1 hour 10 minutes the space between the point and frame rail along the length of 4.5 m was completely clean of snow. On this length the snow melted on the frame rail itself and on the metal parts near the frame rail.

The temperature of the rail head was equal to +5°–+12° C., while the temperature of the surface of the condensation chamber was 90°–92° C.; active melting of snow and evaporation of moisture were observed all the time.

With the operating heat-transfer device all switching operations were effected without using any additional labour force of the operating personnel for cleaning the snow. After the snowfall stopped, the heat-transfer devices were switched off.

Example 2

The heat-transfer device for heating rooms and shops, for example, livestock rearing farms, has the following overall dimensions:

| | |
|---|---|
| Length of condensation chamber, m | 10.5 |
| Outer diameter of condensation chamber, m | 0.034 |
| Quantity of joints on condensation chamber, pieces | 2 |
| Type of joints: flanges with diameter with Tephlon gasket. | 80 mm |
| Height of mounting the condensation chamber above the liquid zone of evaporation chamber, m | 0.2 |
| Diameter of evaporation chamber, m | 0.25 |
| Height of evaporation chamber, m | 0.17 |
| Heat carrier | acetone |
| Quantity of liquid heat carrier, l | 4.5 |
| Power of electric heating sources in heat-transfer device, W | 2000 |

The heat-transfer device was mounted along the wall of the shop being heated.

11 minutes after switching on the heat-transfer device, the surface temperature of the condensation chamber was equal to 80° C. and continued to increase during one hour twenty minutes with deviations from the average surface temperature not higher than ±0.8° C. 1 hour 30 minutes after switching on the heat transfer device, the temperature of the surface of the condensation chamber was 150° C., the temperature deviation along the length of the condensation chamber being not in excess of ±6° C., while the temperature inside the room was equal to 20°–22° C.

We claim:

1. A heat-transfer device, comprising an evaporation chamber; a space of said evaporation chamber having a liquid zone and a vapor zone; at least one heating source for said evaporation chamber; a condensation chamber made in the form of a pipeline and installed essentially horizontally along an object to be heated; a space of said condensation chamber; a tube used for supplying vapor into the space of said condensation chamber and for returning the condensed liquid into the space of said evaporation chamber arranged in the space of said condensation chamber along its longitudinal axis, the space of said tube being communicated with the spaces of said evaporation chamber and condensation chamber; at least two branch pipes, fluid-flow and vapor-flow; one of said branch pipes being communicated with the vapor zone of said evaporation chamber and the other of said branch pipes being communicated with the liquid zone of said evaporation chamber, the space of the tube is communicated with the vapor zone of the evaporation chamber through the vapor-flow branch pipe, while the space of the condensation chamber is communicated through the fluid-flow branch pipe with the liquid zone of the evaporation chamber; dividing means being mounted inside of the fluid-flow branch pipe for directing a heat carrier, flowing from said condensation chamber, away from said vapor zone of the evaporation chamber into the liquid zone thereof; the vapor-flow branch pipe being located inside of the fluid-flow branch pipe; said dividing means being formed as a half-ring closing an annular gap between walls of the vapor-flow branch pipe and the fluid-flow branch pipe through which the condensed heat carrier being returned into the evaporation chamber, said half-ring being mounted at an angle to the plates closing longitudinal gaps between said walls of the branch pipes.

2. A device according to claim 1 wherein said dividing means is a partition.

3. A device according to claim 1, in which the condensation chamber and tube are detachable.

4. A device according to claim 3, in which flanges with a gasket are mounted on the condensation chamber at the joint and a threaded coupling is mounted on the tube.

5. A device according to claim 1, in which at the point of accumulation of noncondensing gases there is mounted a valve for periodic release of these gases from the device.

6. A heat-transfer device, comprising an evaporation chamber; a space of said evaporation chamber having a liquid zone and a vapor zone; at least one heating source for said evaporation chamber; a condensation chamber made in the form of a pipeline and installed essentially horizontally along an object to be heated; a space of said condensation chamber; a tube used for supplying vapor into the space of said condensation chamber and for returning the condensed liquid into the space of said evaporation chamber arranged in the space of said condensation chamber along its longitudinal axis, said tube preventing mixing of vapors and a condensed liquid, the space of said tube being communicated with the spaces of said evaporation chamber and condensation chamber; at least two branch pipes, fluid-flow and vapor-flow; both said pipes passing through the vapor zone of the evaporation chamber and immersing in the liquid zone of the evaporation chamber, one of said branch pipes being communicated with the vapor zone of said evaporation chamber and the other of said branch pipes being communicated with the liquid zone of said evaporation chamber, the space of the tube is communicated with the vapor zone of the evaporation chamber through the vapor-flow branch pipe, while the space of the condensation chamber is communicated through the fluid-flow branch pipe with the liquid zone of the evaporation chamber; both branch pipes in the evaporation chamber have an incision cut being positioned essentially along an axis of the branch pipes, said incision cut accommodating dividing means to separate a condensed liquid flowing from the space of the condensation chamber from the vapor zone of the evaporation chamber.

7. A device according to claim 6, wherein said dividing means is a partition.

* * * * *